US006138335A

United States Patent [19]

Drawbaugh et al.

[11] Patent Number: 6,138,335

[45] Date of Patent: Oct. 31, 2000

[54] CASKET WITH SNAP-ON APPLIQUE

[75] Inventors: Richard A. Drawbaugh, Dover; Aaron S. Will, New Cumberland, both of Pa.

[73] Assignee: The York Group, Inc., Houston, Tex.

[21] Appl. No.: 09/251,071

[22] Filed: Feb. 16, 1999

[51] Int. Cl.[7] ..... A61G 17/00

[52] U.S. Cl. ..... 27/10

[58] Field of Search ..... 27/1, 2, 10, 19

[56] References Cited

U.S. PATENT DOCUMENTS

| | | | |
|---|---|---|---|
| 2,213,506 | 9/1940 | Thoresen | 27/10 |
| 3,025,624 | 3/1962 | Harrell | 27/10 |
| 4,195,394 | 4/1980 | Semon | 27/10 |
| 4,571,790 | 2/1986 | James, III | 27/10 |
| 4,967,455 | 11/1990 | Elder . | |
| 5,353,484 | 10/1994 | Woedel et al. . | |
| 5,454,141 | 10/1995 | Ozbun et al. . | |
| 5,604,965 | 2/1997 | Shaw et al. | 27/10 X |
| 5,960,524 | 10/1999 | Darby et al. | 27/10 X |

*Primary Examiner*—Terry Lee Melius
*Assistant Examiner*—William L. Miller
*Attorney, Agent, or Firm*—Browning Bushman

[57] ABSTRACT

A casket 10 includes a four sided casket box 15 and a lid 16. A pair of appliques 40 may be fitted within a respective recess at the end of each side between a top framing strip 26 and a bottom framing strip 28. The pair of appliques together form a corner covering for each of the four corners of the casket. A pair of side snap members 56, 58, 110 may each be secured to the side adjacent the corner and between the top framing strip and the bottom framing strip. A pair of mating applique snap members 58, 90 may be secured to each applique. Mating engagement of the snap members may be achieved by applying a force perpendicular to a plane of the side 12, 34, thereby reliably mating the snap members and securing the applique to the casket side.

20 Claims, 2 Drawing Sheets

CASKET WITH SNAP-ON APPLIQUE

FIELD OF THE INVENTION

The present invention relates to caskets for the final disposal of human remains. More particularly, this invention relates to a casket including a casket box having a top framing strip and a bottom framing strip, and to an improved connector for securing an applique on a casket side between the top and bottom framing strips.

BACKGROUND OF THE INVENTION

Caskets have been used for decades for the final disposal of human remains, whether by burial, cremation, or otherwise. The casket itself includes a box for holding the remains of the deceased person, with the box typically having four sides, a bottom, and a top or lid. The casket conventionally includes a top framing strip and a bottom framing strip each extending outward from each of the plurality of sides and defining a side recess therebetween. The top and bottom framing strips provide both strength and rigidity to the casket box, and also create a desired aesthetic appearance. Caskets also conventionally include an interior fabric lining such that most if not all of the interior surfaces of the casket box are covered.

The casket box may be formed from various suitable materials, and commonly is fabricated from wood, or a combination of an interior wooden frame and an exterior metal covering. Regardless of the material used to construct the casket box, a continuing problem involving the manufacture of the casket concerns the appearance of the right-angle corners where two sides mate. For various reasons, a visible corner seam may be aesthetically undesirable when the casket box is fabricated from wood. When the casket box comprises a wooden frame with a metal covering, it is common to bend one side relative to the other to form the right-angle corner and thus avoid a seam. In this case, however, the metal bending process commonly results in some metal stretching or other damage at or closely adjacent the right-angle corners thereby producing undesirable marring to the exterior appearance of the finished casket.

In an effort to overcome the above problems and to add to the attractiveness and appearance of the casket, it has been common to provide right-angle corner pieces which extend between the upper and lower framing strips, thereby covering the corners of the casket. Each corner piece may be glued or nailed to a respective one of the four casket box corners. Gluing the corner piece to the casket walls is messy, and glue drips may damage the exterior appearance of the casket. Nailing the corner piece to the casket walls results in a visible nail head which is aesthetically undesirable, and attempts to cover the nail head frequently are not highly reliable and satisfactory. In some applications, the purpose of the right angle corner piece is achieved by securing an applique to an end of each side of the casket box between the upper and lower framing strips. The combination of two appliques at each corner, with their edges touching or being closely adjacent, thus forms substantially the same appearance as a corner piece. These corner pieces and appliques are commonly provided with a desired marking on the exterior surface thereof, so that the corner pieces or appliques both cover the otherwise exposed casket sides at the corners of the casket box and enhance the beauty and aesthetic appearance of the casket.

The prior art thus includes a casket with appliques each extending between the top and bottom framing strips, with two adjoining appliques at each end of each of the four casket sides effectively forming a corner covering. In prior art applications, each applique preferably had a substantially planar back surface which engaged the exposed planar surface of a box side between the top and bottom framing strips. Both the top edge, bottom edge, left-side and right-side of each applique may have any desired contour, such as those used in edge moldings. As previously noted, the front planar surface of each applique is exposed and is commonly provided with a desired design, such as folded hands, a cross, flowers, etc.

In recent years, it has become increasingly common for the funeral home operator rather than the casket manufacturer to attach the corner pieces or appliques to the corners of the casket box. The funeral home operator may thus keep in inventory a supply of appliques with popular exterior designs thereon. With this technique, a standard casket box may be easily personalized by the funeral home operator securing the corner pieces or appliques which include the desired exterior design selected by the family of the deceased. This technique allows the casket to be easily customized since it is relatively easy to apply any desired design or covering to the small appliques. The customized appliques may then be installed by the funeral home operator to the otherwise standard casket.

While there are thus significant advantages to providing the casket with appliques intended to be secured to the box sides by the funeral home operator, this objective has some difficulties. Funeral home operators are not well equipped to utilize specialized equipment or techniques for securing the appliques to the casket sides. While the operation of gluing an applique to a casket side might be considered relatively simple, the time and expense required to perform this operation is a significant drawback to the funeral home operator. Also, it is imperative that the mechanism used to secure the applique to the box side be highly reliable, and that there be little likelihood of an applique coming off the casket box during, for example, handling of the casket by pallbearers.

Prior art appliques include a stud which is threaded to a hole provided in the rear surface of the applique, with the stud being positioned for fitting through an aperture in the side of the casket box. A substantially universal casket box may thus be provided with a hole adjacent the end of each casket side at each of the four corners, with each hole being positioned for receiving a stud connected to a desired applique. Once the family selects the desired applique, the funeral home operator may place the applique against the side of the casket box with the stud extending through a respective hole. The funeral home operator may then briefly lift or remove a portion of the interior casket fabric lining so that the end of the stud is visible within the interior of the casket box. A wing nut may then be threaded to the exposed stud, thereby fixing the applique to the side of the casket. Once the lining is replaced, the applique with the desired configuration has been secured to the casket side. The other seven appliques may each be similarly secured to a casket side, with two appliques effectively forming a corner piece.

The disadvantages of the prior art are overcome by the present invention, and an improved casket is hereinafter disclosed with a preferred mechanism for securely affixing appliques to a casket side, and particularly to each end of a casket side between the top and bottom framing strips. Two adjoining appliques thus effectively form a corner piece which may be easily and reliably attached and, if necessary, detached and replaced with another applique.

SUMMARY OF THE INVENTION

According to one embodiment of the invention, the casket includes a casket box having a plurality of sides, a bottom, and a top or lid. Two of the plurality of sides mate to form a casket corner, and each casket corner may be covered by a pair of appliques as discussed below. Each applique is fitted between a top framing strip and a bottom framing strip extending outward from each side and defining a side recess therebetween. Each applique may be sized for fitting within a respective one of the recesses. Two appliques provide a desired covering to the corner and enhance the aesthetic appearance of the casket.

In a preferred embodiment, a pair of side snap members may be secured to each of the sides adjacent the box corner and between the top framing strip and bottom framing strip. A pair of mating applique snap members are secured to each of the first and second appliques adjacent an interior surface of the applique. One of the snap members has an extending male piece and the other snap member has a female receiving piece, such that mating engagement of the side snap member and a respective mating applique snap member secures the applique to the side, with two of the appliques forming a corner covering.

In another embodiment of the invention, a single applique may be secured by snap members as discussed above to any portion of the side between a top framing strip and a bottom framing strip.

According to the method of the invention, snap members are secured to the side of the casket and to the applique, and a force is applied to the applique in a direction substantially perpendicular to a plane of the side for mating engagement of the side snap member with the respective mating applique snap member, thereby securing the applique to the side.

It is an object of the present invention to provide an improved casket of the type having a plurality of sides, a bottom and a top. An applique is applied to a side utilizing one snap member secured to the side and another snap member secured to the applique.

It is another object of the present invention to provide improvements to a casket wherein one or more appliques may be reliably and easily secured to a casket side, but may also be easily removed and replaced with another applique.

Still another object of the invention is to provide an improved method of securing an applique to a side of a casket. The casket side and the applique are each provided with a snap member, and a force is applied to the applique in a direction perpendicular to a side to matingly engage the snap members, thereby securing the applique to the side.

It is a feature of the invention that the applique is sized such that the top surface of the applique is closely adjacent the bottom of the top framing strip and the bottom surface of the applique is closely adjacent the top surface of the bottom framing strip, yet the applique may be easily and reliably secured to the side of a casket. Still another feature of the invention is to provide two vertically spaced side snap members and two corresponding mating applique snap members for securing each applique to a side of the casket.

Another feature of the invention is that plastic snap members may be used, with each snap member including annular ribs for securing the snap member within a snap receiving cavity. In another embodiment, metal snap members may be used, and each snap member may be secured in place by a respective screw.

Another feature of the invention is to provide the casket with an applique which includes a removal cavity extending into at least one of a top edge, a bottom edge, a left-side edge, and a right-side edge of each applique for assisting in the removal of the applique from the respective side. In a preferred embodiment, the removal cavity is provided in a bottom edge of the respective applique. A removal tool may be used for easy removal of the applique from the casket side.

A significant advantage of the present invention is that the applique and the snap members for reliably securing the applique to a casket side wall are relatively inexpensive. A related advantage is that the appliques may be easily and reliably secured to a casket side wall by a funeral home operator.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
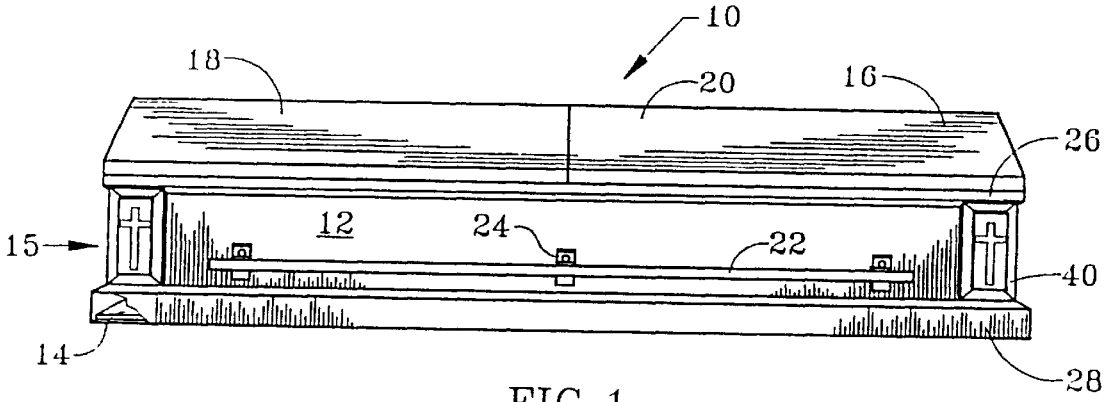
FIG. 1 is a side view of a suitable casket according to the present invention with an applique at each end of a casket side wall.

FIG. 1 illustrates a completed casket 10 in accordance with the present invention. The casket conventionally includes four sides 12, namely a left-side wall, and a right-side wall, a front wall and a rear wall. The casket also includes a bottom 14 which, together with the four sides, defines an open top box 15. A top or lid 16 may be conventionally provided in two pieces, such that either the front piece 18 or the rear piece 20 may be individually moved from the opened to the closed position, generally via a conventional hinge assembly (not shown). The right-side wall and the left-side wall of the casket are each conventionally provided with a side handle 22 which is secured to the respective wall by fastening brackets 24. Each of the four side walls 12 is provided with a top elongate framing strip 26 and a bottom elongate framing strip 28. These framing strips 26, 28 provide the desired aesthetic appearance to the casket and also strengthen the casket box 15.

Figure 2:
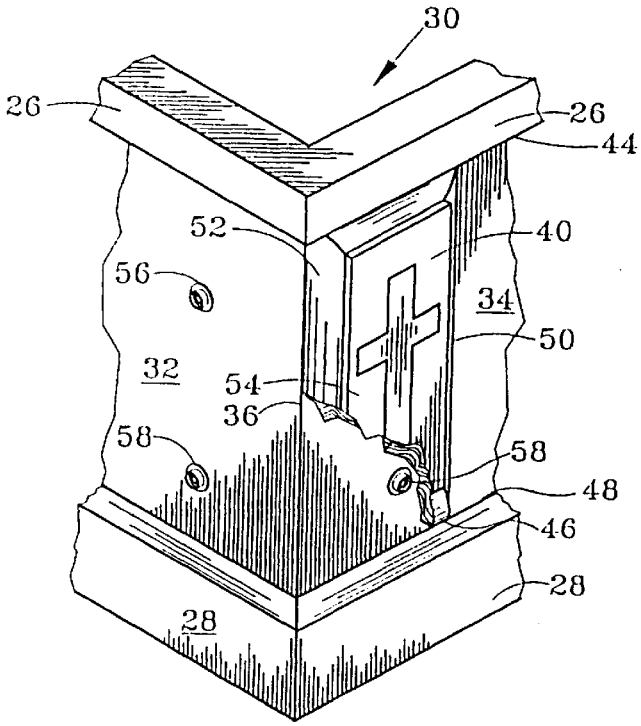
FIG. 2 is a pictorial view of a corner of a casket box, with one applique being shown in cross-section and installed on one of the casket sides.

FIG. 2 depicts a corner 30 formed by the mating engagement of a rearward end of a left-side wall 32 and the left-side end of the rear wall 34. The mating engagement of these walls forms a conventional seam 36, which is visible in FIG. 2 since the applique has not been positioned on the left-side wall 32, and a portion of the applique 40 positioned on the rear wall 34 is removed for clarity. As shown in FIG. 2, the applique 40 has a generally rectangular configuration, with the top edge 42 of the applique (see FIG. 4) being closely adjacent the bottom surface 44 of the top framing strip 26, and the bottom edge 46 of the applique 40 being similarly closely adjacent the top surface 48 of the bottom framing strip 28. The right-side wall 50 of the applique 40 and the left-side wall 52 of the applique are preferably substantially parallel and, along with both the top wall and bottom wall of the applique, conventionally have a decorative edge configuration. The exterior surface 54 of the applique may be provided with a decorative logo.

Figure 3:
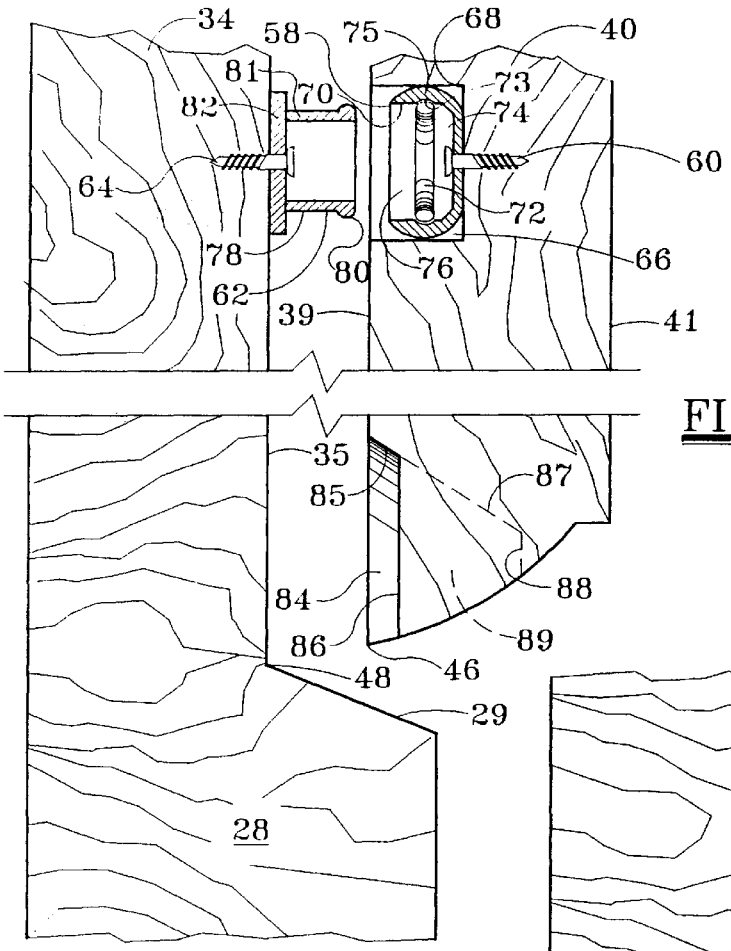
FIG. 3 is a cross-sectional view of a portion of the applique being positioned for securing to a side of a casket.

FIG. 2 illustrates an upper snap member 56 and a lower snap member 58 secured to the rearward end of the left-side wall 32 adjacent the seam 36. The vertically spaced snap members 56 and 58 may each be secured by a conventional screw 64 as shown in FIG. 3 to the left-side wall 32. The rearward wall 34 is similarly provided with vertically spaced upper and lower snap members 56 and 58, with only the lower snap 58 being shown in FIG. 2. The upper snap member secured to the wall 34 is thus covered by the applique 40.

It should be understood that when the applique 40 is installed on the left-side end of the rearwall 34 and a similar applique is installed on the rearward end of the left-side wall 32, the combination of the first and second appliques 40 effectively form a decorative corner covering which both covers the corner portions of the walls 32 and 34 to hide any defects, and which also provides the desired decorative logo on each applique. The left-side wall 52 of the applique 40 secured to the rear wall 34 would thus conventionally be adjoining or very closely adjacent the right-side wall of a similar applique covering the rearward end of the left-side wall 32 shown in FIG. 2. Although the other corners of the casket box are not shown, it should be understood that FIG. 2 is representative of each of the four corners of the casket, and accordingly two adjoining appliques form one corner covering, so that eight appliques effectively cover each of the four corners of the casket 10.

FIG. 3 depicts in further detail a male member 62 for mating engagement with the female snap member 58. The male snap member 62, which in this embodiment is the wall snap member, may be reliably secured to the exterior surface 35 of the side 34 of the casket by a suitable wood screw 64, and a similar screw 60 may be used to retain the female snap member 58, which in this embodiment is the applique snap member, within the cylindrical shaped pocket 66 provided in the interior wall 39 of the applique 40. When the snap members 62 and 58 are brought into engagement, the interior surface 39 of the applique thus covers the exterior surface 35 of the side 34. As previously noted, the exterior surface 41 of the applique 40 is exposed, and may have a suitable design thereon.

The snap members 62 and 58 as shown in FIG. 3 are each fabricated from metal. The male snap member 62 has a generally cylindrical exterior surface 78 and an outwardly extending annular lip 80. A male piece 81 thus extends outwardly from a circular-shaped flange plate 82. Screw 84 presses the flange plate 82 into fixed engagement with the surface 35, and no other holes or apertures need be drilled in the side 34 of the casket to retain the snap member 62 in place.

The cylindrical pocket 66 in the applique 40 has a base surface 68. The applique snap member 58 is secured against the base surface 68 by another wood screw 60. The snap member 68 includes a female receiving pocket 76 therein which is formed in the generally cylindrical interior surface 70 of the snap member 58. An annular groove 73 is provided for receiving an annular metal split snap ring 72 therein. When the snap members are positioned as shown in FIG. 3, the interior surface of the snap ring 72 thus has a diameter less than the diameter of the lip 80. As the male piece 81 is inserted into the pocket 76 of the female piece 75, the lip 80 expands the diameter of the snap ring 72. Once the lip 80 passes by the snap ring 72, the snap ring 72 springs back to substantially its original diameter, thereby effectively locking the male piece 81 within the female piece 75. The snap ring 78 includes a substantially planar back wall 74 which engages the end wall 68 when the wood screw 60 secures the snap ring 58 in the pocket 66.

FIG. 3 also depicts the lowermost edge 46 of the applique 40 which will be closely adjacent the uppermost edge 48 of the wall 34 when the applique is installed. To assist in removal of the applique 40, a removal cavity 84 is formed in the bottom edge of 40. The cavity 84 includes an upper tapered surface 85 and a back wall 86. The size of the cavity 84 is intended for receiving a suitable tool, such as shown on FIG. 5, so that the applique may be easily pried off the casket side 34.

Figure 5:
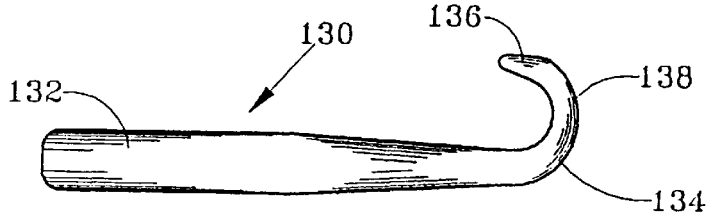
FIG. 5 is a side view of a suitable tool for removing an applique from a side of a casket.

Referring briefly to FIG. 5, a suitable tool 130 may be formed from metal, and includes a handle 32 having a hook end 34 thereon. The pointed end 136 is thus intended for fitting within the cavity 84, such that a funeral home operator may easily pry an applique off the side 34 using the tool 130. During this prying operation, the surface 138 of a tool may thus engage the top angled surface 29 of the bottom framing strip 28. Very little force is necessary to remove the applique from a side 34 although, if desired, the surface 29 may be first covered with a suitable protective member, such as a cloth or piece of cardboard.

Figure 6:
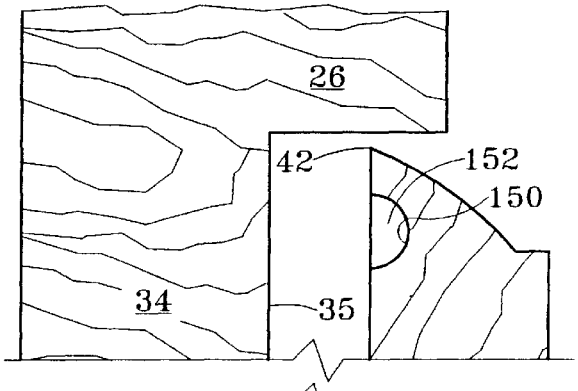
FIG. 6 is a back view of a lower portion of an applique with a finger removal cavity.
Figure 6:
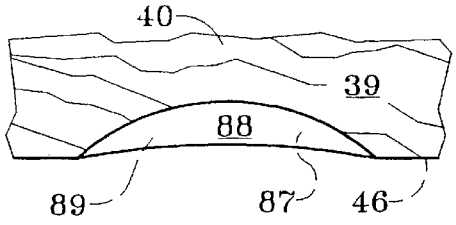

FIG. 3 also discloses the general outline of a larger removal cavity 89 formed by a deeper angled surface 87 and end wall 88. The larger removal cavity 89 shown in dash lines in FIG. 3 may be provided so that one or more fingers of the funeral home operator may be positioned within this larger cavity, and the applique then removed by simply inserting the fingers within the larger cavity and pulling the applique 40 away from the wall 34. In this alternative embodiment, no tool is thus required to remove the applique. A back view of an applique with this finger removal cavity 89 is shown in FIG. 6.

Figure 4:
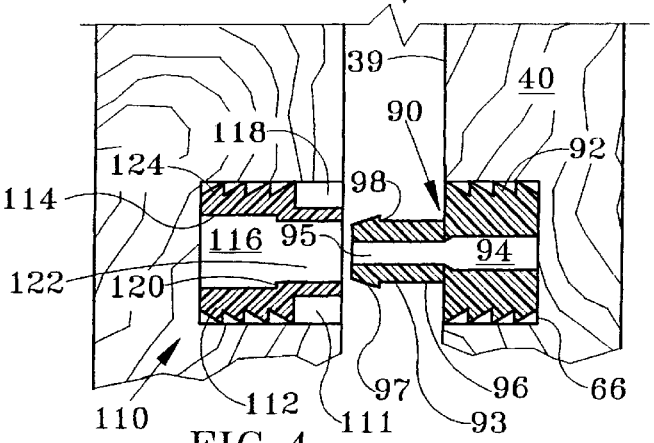
FIG. 4 is a cross-sectional view of another embodiment of a connector for securing an applique to a casket side.

FIG. 4 illustrates another embodiment of the invention, wherein a plastic snap ring with a male piece and a plastic snap ring with a female receiving cavity are provided. For the embodiment shown in FIG. 4, the applique 40 has a reduced width, and the male piece snap ring 90 is thus fitted within the cylindrical pocket 66 in the applique 40, and the female snap ring 110 is fitted within the cylindrical pocket 111 in the side 34. The male snap ring includes a plurality of annular ribs 92, and the female snap ring 110 includes similar ribs 112. These ribs allow each snap ring to be easily pushed into the respective pocket, but the ribs reliably secure each snap ring within the respective pocket and thus retain each snap ring within its pocket. The male snap ring 90 may include a cylindrical cavity 94 spaced interior of the ribs 92. The male piece 93 includes a generally cylindrical outer surface 96, a tapered tip 97 and an annular catch lip 98. If desired, a small cylindrical passageway 95 may be provided through the male piece 93. The applique snap members 58, 90 are preferably spaced substantially midway between a right-side edge 50 and a left-side edge 52 of the applique.

The plastic side snap ring 110 includes a cylindrical passageway 116 for receiving the tapered tip 97. The reduced diameter portion 122 of passageway 116 has an axial length sized to allow the lip 98 to be secured against the stop surface 120. The entry sleeve 118 may have a reduced thickness to facilitate easy initial insertion of male piece 93 into the female piece 124.

FIG. 4 also discloses an applique removal cavity 152. The cavity 152 may be provided in a side of the applique which is opposite the corner seam. The cavity 152 may have a uniform diameter, and may extend from the side a selected distance, e.g., one quarter the width of the applique. A conventional pencil or pen may then be inserted into the cavity 152, and the pen then pulled away from the side wall 34. Engagement of the pen with the wall 150 will thus act to pry the applique 40 from the side wall 34.

A removal cavity as disclosed herein may thus be provided in at least one of the top edge, bottom edge, left-side edge, and right-side edge of each of the appliques. A disadvantage of the embodiment shown in FIG. 4 is that both a left-side applique and a right-side applique may be desirable, since the removal cavity 152 would be more clearly visible if it were provided in the side of the applique which was adjoining the corner seam. Accordingly, the embodiments as shown in FIG. 3 and 6 are preferable since, by providing the removal cavity in one of the top edge and bottom edge of the applique, and preferably in the bottom edge, both left-side and right-side appliques are not necessary. It has been found that the removal cavity of the bottom edge does not substantially detract from the aesthetic appearance of the casket.

In another embodiment of the invention, a suitable applique as disclosed herein may be fitted within a recess between the top framing strip and the bottom framing strip using one or more applique snap members and one or more side snap members. In this case, however, the applique may be fitted at any desired position along the side of a casket, and need not be provided at the corners. One or more appliques may thus be positioned at various selected positions along the length of the casket side and between the top and bottom framing strips to enhance the aesthetic appearance of the casket.

According to the method of the invention, the side snap members may be secured at the desired positions in the side of the casket, and the casket may then be shipped to the funeral home operator. Appliques with the desired exterior logo may be retained in inventory by the funeral home operator. Once the appliques are selected, the appliques may be easily secured by the funeral home operator to the sides of the casket. If desired, "blank" appliques with no exterior logo may also be retained by the funeral home operator, and either the funeral home operator or the family of the deceased may have any special covering or logo placed on or inscribed within the blank applique.

The funeral home operator may easily secure the applique to the casket side by applying a force in a direction perpendicular to the plane of the casket side, thereby reliably mating the snap members. This desired force may be generated by the funeral home operator positioning the snap members with one hand and then using the end of his fist to "pop" the snap members together, thereby securing the applique to the side of the casket. According to another method, a rubber mallet may be used to hit the exterior surface of the applique to secure these snap members together. If for some reason it is desired or necessary to remove an applique, a tool 130 as disclosed herein may be used to easily perform this operation. In other embodiments, the funeral home operator may position his fingers within the removal cavity to pry the applique off the side. In another application, a pencil or pen may be used as a suitable tool for prying an applique off the side. Even if no removal cavity is provided in the applique, the funeral home operator may be able to grip the sides of the applique and simply pull the applique off the side. If desired, a screwdriver or other prying tool may be used for insertion between the exterior surface 35 of the side and the interior surface 39 of the applique.

Either metal snap members or plastic snap members may thus be used to secure each applique to a casket side. While two different types of snap members have been discussed in detail above, those skilled in the art will appreciate that various types of snap members may be used for this purpose, with each snap member including an outward extending male piece and a receiving female piece. The engagement of the snap members is accomplished by applying a force to the applique in a direction perpendicular to a plane of the casket side. Also, the embodiments discussed above disclose the use of a screw or annular ribs to retain the snap members within a respective pocket provided in the casket side or applique, or to the wall of the casket or applique. Those skilled in the art will appreciate that other conventional types of securing members and techniques may be used for affixing each snap member to the casket wall or applique.

It is a particular feature of the invention that each applique is secured to a side of the casket with two vertically spaced snap members, with the snap members each being spaced substantially midway between a right-side edge and a left-side edge of the applique. The advantage of two snap members on each applique is that the applique then cannot twist or rotate once it is applied to the casket side. Although such twisting movement would be very limited if the applique is sized to fit snugly between the top and bottom framing strips, even a limited amount of movement of the applique installed on the casket side is undesirable. By providing two snap members on the applique, with each of the snap members preferably being vertically spaced, the applique is reliably secured in a fixed position to the casket side.

Various other modifications may be made to the casket as disclosed herein and to the method of securing an applique to a side of a casket without departing from the spirit of the invention. Such further modifications should become apparent to those skilled in the art in view of the above disclosure. It should thus be understood that the invention is not limited to the disclosed embodiments, and instead it should be understood that the scope of the invention should include all embodiments within the scope of the following claims.

What is claimed is:

1. A casket, comprising:

a casket box for holding the remains of a deceased person, the casket box having a plurality of sides, a bottom, and a top, two of the plurality of sides mating to form a box corner;

one or more side snap members each fixedly secured to one of the two sides adjacent the box corner, wherein each of the two of the plurality of sides are provided with the one or more side snap members;

a first and a second applique each for fitting over a respective one of the two sides adjacent the box corner, such that the first and second appliques together form a corner covering, each applique having an interior surface for covering the exterior surface of a respective one of the two sides; and one or more mating applique snap members each fixedly secured to one of the first and second appliques adjacent the interior surface of the one applique wherein each of the first and second appliques, are provided with the one or more snap members, each of the one or more side snap members including one of an outward extending male piece and a receiving female piece for selective mated engagement with the male piece, and each of the one or more applique snap members including the other of the outward extending male piece and the receiving female piece, each of the male piece and the female piece being positioned entirely outward of an interior surface of the box corner, such that the mating engagement of each of the one or more side snap members with a respective one of the one or more mating applique snap member secures the applique to a respective one of the two sides with the interior surface of the applique covering the exterior surface of the side adjacent the box corner.

2. The casket as defined in claim 1, further comprising:

a top framing strip and a bottom framing strip each extending outward from the two sides and defining a first and a second side recess therebetween, each side recess extending from a top of the bottom framing strip to a bottom of the top framing strip; and each of the first and second appliques is sized such that a top surface of each applique is closely adjacent the bottom of the top framing strip and a bottom surface of the applique is adjacent the top surface of the bottom framing strip.

3. The casket as defined in claim 1, wherein the one or more side snap members include at least two vertically spaced side snap members, and wherein the one or more snap members include at least two vertically spaced mating applique snap members.

4. The casket as defined in claim 1, wherein each of the one or more mating applique snap members secured on the respective applique is spaced substantially midway between a right-side edge and a left-side edge of the respective applique.

5. The casket as defined in claim 1, wherein each of the one or more side snap members on each of the two sides and each of the one or more mating snap members on each of the first and second appliques is formed from a plastic material, and each plastic side snap member and each plastic mating applique snap member includes exterior ribs for securing the snap member within a snap receiving cavity in the side or applique.

6. The casket as defined in claim 5, wherein each of the one or more mating applique snap members includes the male piece extending inward from the interior surface of the applique, and wherein each of the one or more side snap members includes the female piece within the snap receiving cavity in the side.

7. The casket as defined in claim 1, wherein each of the one or more side snap and each of the one or more mating applique snap members is formed from metal, and each metal side snap member and each metal mating applique snap member is secured to the respective side or applique by a screw.

8. The casket as defined in claim 1, wherein the casket box plurality of sides is four sides, the box corner is four box corners, and the first and second appliques are eight appliques forming four corner coverings.

9. The casket as defined in claim 1, further comprising:

a removal cavity extending into at least one of the top edge, bottom edge, left-side edge and right-side edge of each of the first and second appliques for assisting in removal of the applique from the respective side.

10. The casket as defined in claim 9, wherein the removal cavity extends into a bottom edge of the respective applique.

11. A casket, comprising:

a casket box for holding the remains of a deceased person, the casket box having a plurality of sides, a bottom, and a top;

a top framing strip and a bottom framing strip each extending outward from one of the plurality of sides and defining a side recess therebetween, the side recess extending from a top of the bottom framing strip to a bottom of the top framing strip;

a side snap member secured to the one of the plurality of sides and between the top framing strip and the bottom framing strip;

an applique for fitting within the side recess, the applique having an interior surface for engagement with an exterior surface of the side, the applique being sized such that a top surface of the applique is below the bottom of the top framing strip and a bottom surface of the applique is above the top of the bottom framing strip, and an applique snap member secured to the applique adjacent the interior surface of the applique, the side snap member including one of an outward extending male piece and a receiving female piece, at least one of the male piece and the female piece including a deflection member for deflection during snapping engagement of the male and female piece, and the applique snap member including the other of the outward extending male piece and the receiving female piece, such that the mating engagement of the side snap member with the mating applique snap member secures the applique to the side.

12. The casket as defined in claim 11, wherein the side snap member includes at least two vertically spaced side snap members, and wherein the mating snap member include at least two vertically spaced mating applique snap members.

13. The casket as defined in claim 11, wherein the applique snap member is spaced substantially midway between a right-side edge and a left-side edge of the applique.

14. The casket as defined in claim 11, further comprising:

a removal cavity extending into at least one of the top edge, bottom edge, left-side edge and right-side edge of the applique for assisting in removal of the applique from the side.

15. A method of securing an applique to one side of a casket box for holding the remains of a deceased person, the casket box having a plurality of sides, a bottom, and a top, and the method comprising:

securing one or more side snap members to the one side;

securing one or more mating applique snap members to the applique adjacent an interior surface of the applique, each of the one or more side snap members including one of an outward extending male piece and a receiving female piece, and each of the one or more applique snap members including the other of the outward extending male piece and the receiving female piece, at least one of the male piece and the female piece including a deflecting member for deflection during snapping engagement of the male and female piece, and applying a force to the applique generally perpendicular to a plane of the side for mating engagement of the one or more side snap members with the respective mating applique snap member, thereby securing the applique to the side.

16. The method as defined in claim 15, further comprising;

providing a top framing strip and a bottom framing strip each extending outward from the side and defining a side recess therebetween, the side recess extending from a top of the bottom framing strip to a bottom of the top framing strip; and sizing the applique such that a top surface of the applique is closely adjacent the bottom of the top framing strip and a bottom surface of the applique is adjacent the top of the bottom framing strip.

17. The method as defined in claim 15, further comprising securing the one or more side snap members including vertically spacing at least two spaced side snap members on the side and securing the one or more mating applique snap members including vertically spacing at least two mating applique snap members on the applique;

positioning each of the at least two applique snap members substantially midway between a right-side edge and a left-side edge of the applique.

18. The method as defined in claim 17, further comprising:

the applique including first and second appliques;

securing the at least two side snap members to the one side and an adjacent side;

securing the at least two applique snap members to each of the first and second appliques; and securing the first and second appliques to the respective one side and adjacent side such that edges of the first and second appliques adjoin to form a corner covering.

19. The casket as defined in claim 15, further comprising:

forming a removal cavity extending into at least one of the top edge, bottom edge, left-side edge and right-side edge of each of the applique for assisting in the removal of the applique from the side.

20. The method as defined in claim 19, wherein the removal cavity is formed into the bottom edge of the applique; and prying the applique from the side with a tool fitted at least partially within the removal cavity.

* * * * *

UNITED STATES PATENT AND TRADEMARK OFFICE

CERTIFICATE OF CORRECTION

PATENT NO. : 6,138,335

DATED : October 31, 2000

INVENTOR(S) : Richard A. Drawbaugh and Aaron S. Will

It is certified that error appears in the above-identified patent and that said Letters Patent are hereby corrected as shown below:

In Column 8, line 57, change "applique wherein" to --applique, wherein--.

In Column 8, line 58, change "appliques, are" to --appliques are--.

Signed and Sealed this

Eighth Day of May, 2001

*Attest:*

Nicholas P. Godici

NICHOLAS P. GODICI

*Attesting Officer*

*Acting Director of the United States Patent and Trademark Office*